US007810367B2

(12) United States Patent
Kipry

(10) Patent No.: US 7,810,367 B2
(45) Date of Patent: Oct. 12, 2010

(54) METHOD OF SHAPING A METALLIC HOLLOW MEMBER IN A SHAPING TOOL AT INCREASED TEMPERATURE AND UNDER INTERNAL PRESSURE

(75) Inventor: Karl Kipry, Sonnenberger Strasse 33, Wiesbaden (DE) D-65193

(73) Assignees: Karl Kipry (DE); Peter Amborn (DE)

( * ) Notice: Subject to any disclaimer, the term of this patent is extended or adjusted under 35 U.S.C. 154(b) by 1082 days.

(21) Appl. No.: 11/509,242

(22) Filed: Aug. 23, 2006

(65) Prior Publication Data

US 2006/0283224 A1 Dec. 21, 2006

Related U.S. Application Data

(63) Continuation-in-part of application No. PCT/DE2004/002821, filed on Dec. 30, 2004.

(30) Foreign Application Priority Data

Mar. 20, 2004 (DE) ..... 10 2004 013 872

(51) Int. Cl.
*B21D 9/18* (2006.01)

(52) U.S. Cl. ..... 72/62; 72/57; 72/60; 72/342.7; 72/342.92; 72/342.96

(58) Field of Classification Search ..... 72/58, 72/60, 61, 62, 370.22, 342.7, 342.8, 342.94, 72/342.96; 29/421.1
See application file for complete search history.

(56) References Cited

U.S. PATENT DOCUMENTS 4,763,503 A * 8/1988 Hughes et al. ..... 72/57
5,683,608 A 11/1997 Matsen et al.
5,992,197 A 11/1999 Freeman et al.
7,269,986 B2 * 9/2007 Pfaffmann et al. ..... 72/60

(Continued)

FOREIGN PATENT DOCUMENTS

DE 25 06 701 8/1976

(Continued)

OTHER PUBLICATIONS

International Search Report PCT/DE2004/002821 dated May 19, 2005.

*Primary Examiner*—David B Jones
(74) *Attorney, Agent, or Firm*—Gifford, Krass, Sprinkle, Anderson & Citkowski, P.C.

(57) ABSTRACT

The subject matter of the present invention is a method of shaping a metallic hollow member in a shaping tool (1, 20, 50) at increased temperature and under internal pressure, said hollow member (5) protruding at one end at least from said shaping tool (1), the configuration of the tool mold and/or the shaping parameters acting onto said hollow member being selected in such a manner that said hollow member (5, 59) substantially keeps its original shape outside said tool (1, 20, 50), with said tool being heated in the region of the cavity and a tool, said tool being completely made from a homogeneous ceramic material with the component part being heated inductively, the cavity having a tribological additional coating in order to minimize friction of the component part against the wall and/or the affinity of the component part with the material of the cavity wall.

16 Claims, 9 Drawing Sheets

U.S. PATENT DOCUMENTS

| | | | | |
|---|---|---|---|---|
| 7,305,860 | B2 * | 12/2007 | Yang et al. | 72/61 |
| 7,464,572 | B2 * | 12/2008 | Miyanaga et al. | 72/58 |
| 2002/0003011 | A1 | 1/2002 | Dykstra et al. | |

FOREIGN PATENT DOCUMENTS

| | | | |
|---|---|---|---|
| DE | 41 04 082 | C2 | 8/1992 |
| DE | 196 42 824 | A1 | 4/1998 |
| DE | 197 19 629 | A1 | 11/1998 |
| DE | 199 38 452 | A1 | 2/2001 |
| EP | 0 771 598 | A1 | 5/1997 |
| JP | 56017132 | A1 | 2/1981 |

* cited by examiner

METHOD OF SHAPING A METALLIC HOLLOW MEMBER IN A SHAPING TOOL AT INCREASED TEMPERATURE AND UNDER INTERNAL PRESSURE

CROSS-REFERENCES TO RELATED APPLICATIONS

This is a continuation in part application of PCT/DE2004/002821 filed on Dec. 30, 2004 which claims Priority from German Application No. DE 10 2004 013 872.9 filed on Mar. 20, 2004

FIELD OF INVENTION

The invention relates to a method of shaping a metallic hollow member in a shaping tool at increased temperature and under internal pressure.

DESCRIPTION OF THE PRIOR ART

A method of shaping plastic parts is known from U.S. Pat. No. 5,683,608. Shaping of plastic parts however is performed at temperatures and pressures that are different from those used for shaping metallic objects.

In most of the known technologies for hot working metallic hollow members under internal pressure, the entire hollow member is placed into a shaping tool in which it is given its shape. Usually, the shaping tool has two cavities, namely on the one side what is termed a shaping cavity in which shaping takes place and on the other side what is called a neutral cavity in which no shaping takes place. In the region of the neutral cavity, said cavity prevents the hollow member from expanding when internal pressure is applied at the corresponding temperatures, this being undesirable. If, for feeding further material for shaping, the hollow member is compressed, prior art requires that the end of the hollow member which is to be compressed be located in the region of the tool mold, more specifically in the region of the neutral cavity. With hollow members protruding from the tool mold, the hollow member could otherwise not be prevented from expanding undesirably at the site of least strength so that it is not possible to feed further material during compression for example. If the supply of material for shaping takes place within the tool mold, meaning within the neutral cavity, it is ensured that no expansion will occur outside of the tool mold, but there is a risk that the frictional forces between hollow member and neutral cavity becomes very high under certain circumstances, this finally strongly impeding the supply of material. The higher the shaping temperature, the more difficult the supply of material will be, this applying particularly if a great amount of material is to be supplied because of the degree of shaping, for example when working T-pieces or other regions of high degrees of shaping.

Hollow members made from metal are also known which have a great length with only part of this length having to be formed by hot working.

In this context, U.S. Pat. No. 5,992,197 already teaches to support and to compress a hollow member outside of the tool. The hollow member is heated in the tool. This document however addresses neither the problem of preventing the hollow member from expanding outside the tool nor the problem of the friction between hollow member and tool when material is fed during compression of the hollow member. In addition, the workpiece is heated inductively. If the workpiece is heated inductively, the tool mold can only be made from a non conductive material. Meaning, the cavity is made from a ceramic material, with the tool itself not being heated during induction heating of the workpiece or hollow member. This means that the tool mold remains substantially cold or has a temperature largely different from that of the workpiece heated by induction heating. Inductively heating the workpiece alone has various disadvantages of particular note is that, when a workpiece is being shaped that is inductively heated, this workpiece almost "freezes" at the very moment the workpiece comes to fit with its outer surface against the engraving in the mold since the major part of the heat is dissipated into the tool. At this moment, shaping cannot proceed. Meaning, it is not possible to continuously shape a workpiece in a tool when the tool itself is not heated. Shaping occurs discontinuously instead because, each time it comes to fit against the cold tool wall, the workpiece needs to be heated again to its shaping temperature at which shaping can be resumed. More specifically in cavities with engravings exhibiting high degrees of shaping, that is to say sharp edges and corners, shaping is almost impossible to perform with a tool by means of which the workpiece is only heated inductively since, in the region of such sharp deviations, meaning sharp corners and edges in the engraving, the workpiece tends to wrinkle before the deviation and even, in the worst of cases, even to crack behind the deviation since material is prevented from being supplied in sufficient amounts.

A similar method as the one taught in U.S. Pat. No. 5,992,197 is disclosed in the document JP 56017132; there again, the workpiece is only heated inductively.

From the document US 2002/003011 A1, a tool in the form of a ceramic member is known in which the ceramic member is configured to have two layers. The workpiece is also heated inductively.

BRIEF SUMMARY OF THE INVENTION

In order to shape such a hollow member, the invention suggests that the hollow member protrudes at one end at least from the shaping tool where it protrudes substantially, meaning in most of the applications by about 30% to 60% of the length of the entire workpiece, that the tool mold is thereby configured and/or the shaping parameters acting on the hollow member selected in such a manner that the hollow member substantially keeps its original shape outside the tool, said tool being heated in the region of the cavity. This is to say that it must be made certain that the part of the metallic hollow member that is protruding from the tool mold and is not to be shaped will not be deformed under the internal pressure needed for shaping. For this purpose, the tool mold must be configured accordingly and/or the shaping parameters acting onto the hollow member must be selected so that the part of the metallic hollow member protruding from the tool mold will not be subject to substantial deformation. The important point here is in particular that the tool mold is heated for receiving that part of the hollow member that is to be shaped.

According to a first variant of the method, there is provided that the hollow member is placed unheated into the pre-heated tool. This way of proceeding requires a workpiece having a small mass as this is the case with the cooling coil of a refrigerator for example. Such a cooling coil of a refrigerator has a meandering shape and has, in the region of the cooling coil, a widened portion for forming the evaporator; said widened portion can be made by hot forming. In this context, there is more specifically provided that the heating means is configured to be planar in particular and to have for example the shape of a heating mat or of a planar heating member that is at least partially formed to conform to the shape of the shaping cavity in order to directly and, as a result thereof, quickly heat the hollow member.

More specifically, the heat distribution over the shaping cavity of the tool is substantially adapted to the degree of shaping desired for the hollow body, that is to say that highest degrees of shaping usually require highest temperatures.

Further, there is provided, in accordance with a feature, that the tool has a neutral cavity that is not heated. The neutral cavity may hereby also be the outlet of the tool, that is to say a portion of the tool is not heated in order to prevent the hollow member outside the tool from being heated to such a point that said hollow member is deformed outside the tool mold because of the internal pressure. Of note is hereby also that the length for example of the neutral cavity in the region of the tool outlet is dimensioned such that the heat in the shaping cavity can effectively be dissipated from the hollow member into the tool so that it is ensured that the hollow member outside the tool mold has a temperature that does not allow for deformation of the hollow member under an imposed internal pressure. In order to ensure such a cooling of the hollow member in the tool outlet, there may be provided that the tool outlet is cooled in the region of the neutral cavity.

In accordance with a second variant there is provided that the metallic hollow member is pre-heated prior to placing it into the shaping tool. Pre-heating the metallic hollow member is necessary whenever the hollow member has a greater mass such as for example in the case of a meander heater in bathrooms. If, by contrast, the hollow member were placed into the tool in a cold condition, the tool would need much longer to heat the hollow member to the shaping temperature. This would considerably increase the cycle time for manufacturing a component part because in series production pre-heating usually takes place outside the shaping tool during shaping of the preceding workpiece.

In accordance with another feature of the invention, the hollow member in the tool may be heated further by inductive heating. Again, there is provided that the tool mold has one neutral cavity in which no shaping takes place and one shaping cavity in which shaping takes place. For the method, there is further provided that, during shaping, the hollow member is compressed from at least one protruding free end in order to feed material, with the temperature in the tool varying over the length of the tool. More specifically, the temperature in the tool outlet or in the neutral cavity is lower than in the shaping cavity in order to ensure that the protruding part of the hollow member will not or not substantially deform under the internal pressure. At need, the protruding part of the hollow member will have to be cooled actively.

In prior art it has been known heretofore that the region of the workpiece that is to be fed is located inside the tool mold for compressing the hollow member in order to feed material. This way of proceeding involves various problems as already discussed herein above. A particular problem is that during compression there is the risk that the hollow part cannot be advanced from the one side, e.g., because of a bend, a swelling or a barrier of another shape or that the part of the workpiece that is to be advanced comes to fit against the neutral cavity and will not reach the region of the high degrees of shaping in the shaping cavity. Only because the protruding part of the hollow member will not deform under applied internal deformation pressure because of its temperature is it made possible to feed material into the shaping cavity from the side of the freely protruding end of the hollow member. With respect to material supply, it has been found in particular that in the case of a hollow member having various degrees of shaping over the length of the shaping cavity the highest shaping temperature should prevail in the region neighboring the highest degree of shaping in order to purposefully feed material there during compression. That is to say that the highest temperature is not in the region of the highest degree of shaping but in the neighboring region. This is in order to allow material to reach the region of low degrees of shaping before the region of the highest degree of shaping acts as a barrier to the supply of material.

If the highest temperature were in the region of the highest degree of shaping, the cavity would possibly also be completely filled at the site of the lower degree of shaping, but there would be the risk of quite low material strength there because an insufficient amount of material only could be supplied, flowing or being advanced from neighboring regions. In the extreme, there is even the risk of the hollow member bursting because of too thin walls. Accordingly, the objective is that the wall thickness of the hollow member be substantially equal over the entire length after shaping.

In this context, it has further been found advantageous that compression occur from the side of the hollow member having the highest degree of deformation if the frictional resistance for shaping the hollow member is highest there because of the hollow member fitting against the shaping cavity. In this context, it is assumed that the hollow member is not configured to have two-fold symmetry over the length over which it lies in the cavity. If transition to the region of the highest degree of shaping is expected to have the highest resistance, uniform molding of the shaping cavity for the purpose of achieving an approximately uniform wall thickness over the length of the hollow member to be shaped is only achieved if compression for supplying material occurs from this side.

In accordance with a particularly advantageous feature there is provided, in order to minimize friction between the hollow member and the shaping cavity, that the hollow member be alternately heated and cooled during shaping, at least on its surface. The background is as follows: If the hollow member is for example heated inductively at a temperature that is higher than the temperature of the shaping cavity, cooling occurs during heating of the hollow member and simultaneous compression if the hollow member fits against the wall of the cavity. Meaning, the temperature difference between the hollow member and the neutral cavity is so great that the hollow member cools down to such an extent while fitting against the shaping cavity that the hollow member comes free from the cavity wall. Then, the hollow member is cooled so as to slightly contract. At this very moment, there is no longer any friction between hollow member and cavity precisely because the two parts are not connected so that it is possible to compress for a short time, allowing material to be supplied without frictional losses between cavity and hollow member. As a result, the shaping cavity is sequentially filled out, with a force constantly acting onto the hollow member for feeding material and the hollow member in the shaping cavity being alternately heated and cooled.

In accordance with another advantageous feature the hollow member is compressed intermittently for supplying material. Compression thereby occurs in the axial direction, with, but also without, internal pressure. This, against the following background. If compression occurs intermittently, the material introduced into the shaping cavity is also heated intermittently in the shaping cavity. Meaning, the shaping cavity is always supplied with cool material through the tool outlet, that is, through the neutral cavity, with no risk for the hollow member to come to fit against the cavity, thus effecting increased friction because of the low temperature of the hollow member in the region of the tool outlet, that is to say in the neutral cavity. This even applies if compression occurs under internal pressure.

Further, there is advantageously provided that the free protruding end of the hollow member is being cooled during intermittent compression. In this context, the free protruding end of the hollow member can be retained during intermittent compression by clamping means provided on the outlet cross section of the hollow member; the clamping means may simultaneously be cooled in order to ensure that the material fed into the tool outlet has a temperature preventing it from fitting against the wall. The clamping means are more particularly configured to be jaws that largely surround the hollow body and are axially and radially movable relative to the hollow member in order to allow for sequentially taking hold thereof and feeding it.

In the case of component parts having regions of higher degrees of shaping on the circumference of the hollow member, such as a T-piece for example, the initial hollow member can be provided with an accumulation of material or an increased wall thickness so as to have material on reserve. This allows the axial material supply to be at least partially eliminated and the degree of shaping to be increased.

In accordance with another embodiment there is provided that, if the axial compression force is constant, the hollow body has the material-specific shaping temperature in the region of the highest degree of deformation, with the tool having a lower temperature than the hollow member in the region of the highest degree of shaping, with the temperature of the tool in the region of the neutral cavity, meaning in the tool outlet, toward the freely protruding end of the hollow member being selected such that, when a given internal pressure is applied onto the hollow member, the protruding free end of the hollow member will not expand. The important point is that the tool has a lower temperature than the hollow member in the region of the highest degree of shaping, with the temperature in the tool outlet being chosen to prevent the workpiece from deforming here. In this case also, the hollow member can be heated inductively.

There is further provided that, with shaping cavities having quite large a volume and a great length as well, the hollow member is prevented from buckling in the shaping cavity and/or before the tool during compression thereof. For this purpose, an antibuckling element for preventing such buckling is provided in the shaping cavity. Depending on the configuration of the shaping tool and/or of the workpiece, this antibuckling element can be disposed in the shaping cavity, before the shaping cavity or before the tool. Said antibuckling element is more specifically characterized in that it is configured to be slidable as shaping proceeds. Meaning, the antibuckling element retracts as the shaping proceeds. In accordance with a particular feature there is provided that the antibuckling element has discrete segments that are disposed axially one behind the other and that are configured to be slidable radially outward as shaping proceeds. This means that, as the shaping proceeds, the antibuckling element allows access to the cavity to be filled out in stages so to say.

There may be further provided that, after the hollow member has been formed in the cavity, an inner surface, which is substantially parallel to the outer surface of the hollow member, is formed, with the axial compression pressure and the material-specific shaping temperature remaining the same, the internal pressure being minimized though. A hollow member shaped in this way and having two walls is suited for being used as a cooling unit, with the outer wall, which may also be configured to be a hollow member, receiving the coolant in order to serve for cooling the internal hollow cylindrical component part.

Another subject matter of the invention is a tool, in particular for carrying out a method in accordance with one or a plurality of the afore mentioned claims, with the tool being made completely solid from a homogeneous ceramic material with the component part being heated inductively, the shaping cavity having a tribological additional coating in order to minimize friction of the hollow member against the wall and/or the affinity of the hollow member with the material of the shaping cavity wall. By choosing the ceramic material accordingly, the hollow member is prevented from adhering on the wall of the shaping cavity during forming, in particular during compression of the workpiece in order to feed further material, and thus from having so to say a structured surface. In this context, it is to be noted that one advantage of hot forming is that the surface of the hollow member is so level and smooth that it can be immediately provided with a lacquer or coated with a ceramic material for example.

In particular in the case of a tool made from a homogeneous ceramic material there is provided that, if high radial forces prevail in the shaping cavity, the tool is biased on its circumference in order to prevent it from rupturing. For this purpose, clamping elements made from metal can be provided in particular.

In accordance with another variant, the tool may also be made from metal, with the tool having, in the region of the shaping cavity, a ceramic coating so that the hollow member is expected to have little affinity with the wall of the cavity. This may be for example zircon nitride, niobium nitride, aluminium titanate or boron nitride.

In accordance with another feature of the invention there is provided that the tool mold, which usually consists of an upper and a lower part, with the two parts being closed once the hollow member that is to be shaped has been placed into the cavity, comprises a hydraulic system disposed beneath the lower part of the tool mold. This against the following background:

In accordance with prior art, the hydraulic system is disposed above the upper movable part of the tool mold. If the hydraulic system becomes leaky, there is always the risk that hydraulic oil penetrates the cavity. Hydraulic oil penetrating this shaping cavity causes, irrespective of the fire hazard involved, the hollow member to be shaped to flow in a more or less uncontrolled manner during shaping. If, accordingly, the hydraulic system is located in the fixed lower part of the tool, there is naturally no risk of oil flowing into the interior of the tool.

As already explained, the tool has an upper and a lower tool part. The tool also shows an induction station for electrically heating the hollow member, possibly a cooling station and an apparatus for applying an internal pressure and/or for compressing the hollow member together with possible cooling members at the tool outlet. The functioning of these additional sets is such that one hollow member is molded with each machine stroke. Meaning, when the tool is closed, shaping begins. Heating of the hollow member to be shaped or which is molded only ends when the shaping tool is opened.

The invention will be described in closer detail by way of example with reference to the drawings.

DETAILED DESCRIPTION OF THE INVENTION

Figure 1A:
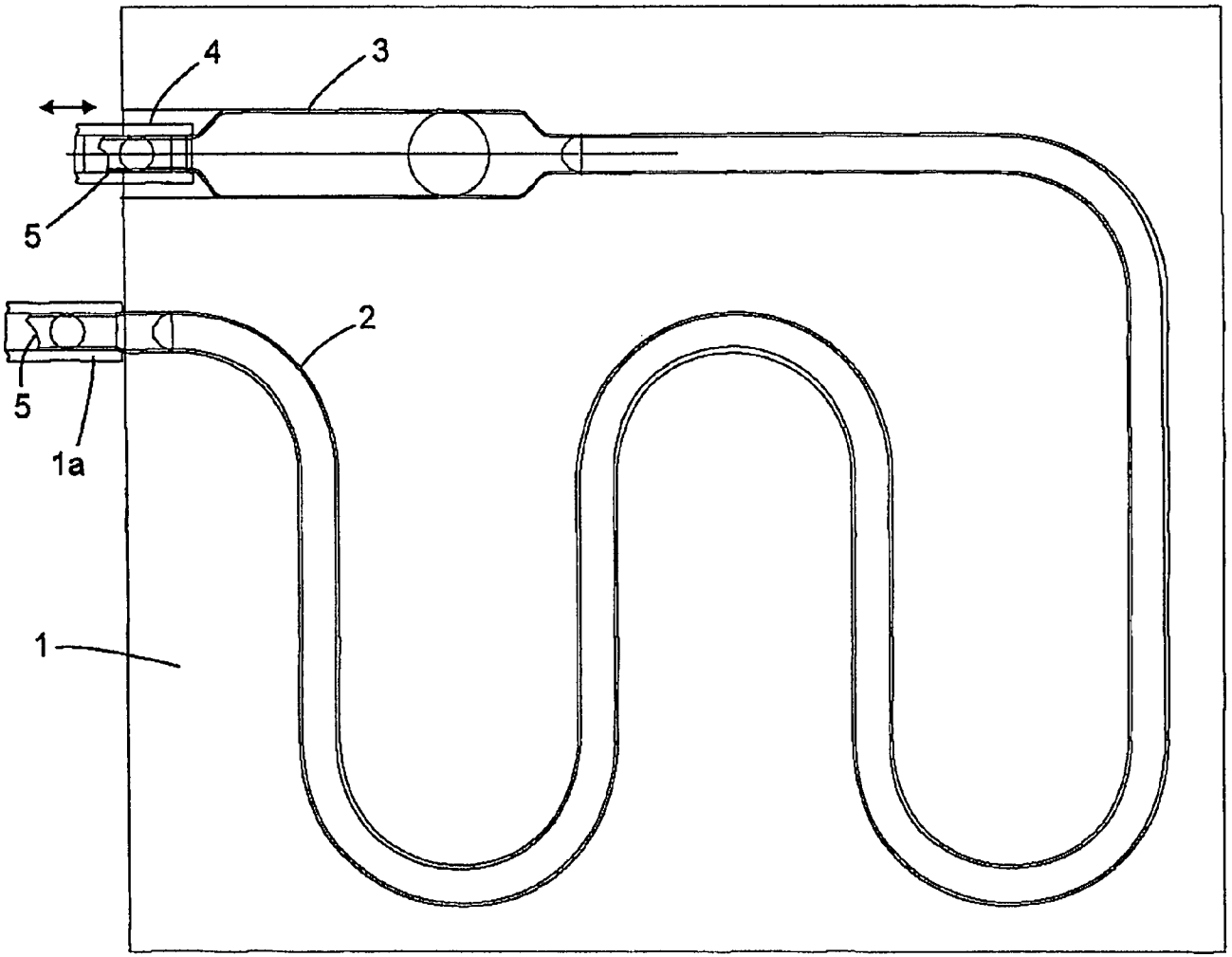
FIG. 1*a* shows a tool mold with a meander-shaped cavity and an external cooling member, a cylindrical cavity being provided in addition to the meander-shaped shaping cavity, with a protection against buckling being provided.

FIG. 1*a* shows a tool 1 that has a meander-cavity 2 adjoined with an elongated cylindrical shaping cavity 3. In the region of the elongated shaping cavity 3 there is provided what is termed an antibuckling element 4. In the simplest case, such an antibuckling element 4 is an axially slidable hollow member the inner dimension of which substantially corresponds to the original dimension of the metallic hollow member 5 to be shaped. As already mentioned, the so-called antibuckling element 4 is axially slidable. This means that the antibuckling element 4 is sequentially slidable from the right to the left in the drawing of FIG. 1, starting from the beginning of the molding process of the elongated cylindrical hollow member 5. In order to make certain that the antibuckling element is slidable within the shaping cavity, there is more specifically provided that the antibuckling element is adapted to be cooled in order to prevent the hollow member to be shaped from expanding, that is in order to ensure that the antibuckling element is axially slidable relative to the hollow body to be shaped.

Another external cooling member is labelled at la and is located at the outlet of the tool.

Figure 1B:
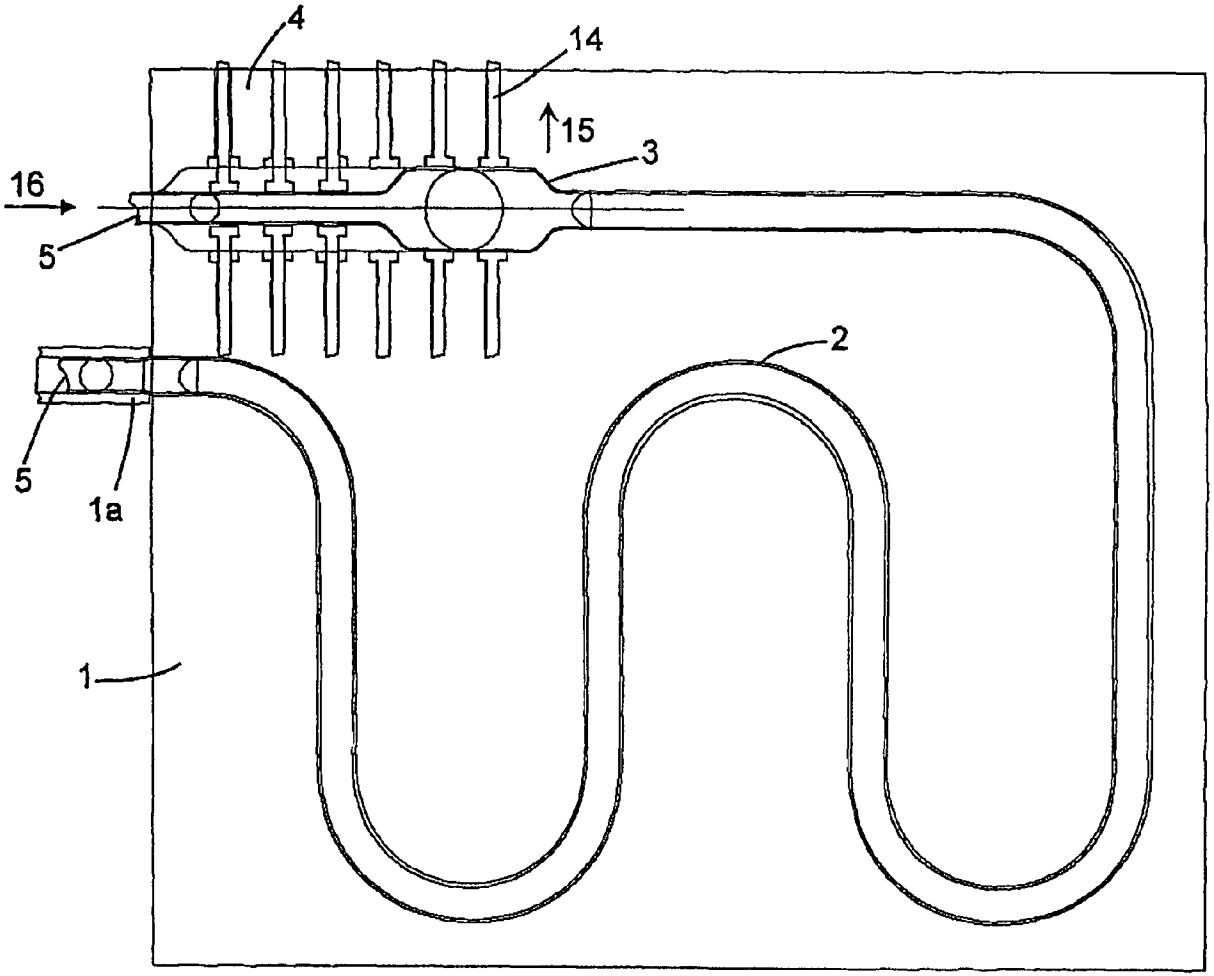
FIG. 1*b* shows a tool in accordance with FIG. 1*a* with another embodiment of the protection against buckling.

Another embodiment of an antibuckling element is apparent from FIG. 1*b;* in the embodiment of FIG. 1*b*, the tool has no axially slidable tubular antibuckling element but an antibuckling element 4 instead that is characterized by a plurality of discrete radially slidable segments 14 which are disposed one behind the other when viewed in the axial direction and which, as already explained, are caused to slide outward in the radial direction as shaping proceeds. Meaning that, at the beginning of the shaping process, all the segments 14 fit against the circumference of the hollow body to be shaped matching the outlet cross section of said hollow body or are spaced a small distance apart therefrom. As shaping of the hollow member in the shaping cavity begins the discrete segments 14 are caused to slide in the direction of the arrow 15. Insofar shaping occurs sequentially, almost in stages, as shown schematically in FIG. 1*b*. An important point hereby also is that this antibuckling element 4 allows for manufacturing a hollow member in the shaping cavity in the most varied shapes, as is evident from the drawing in FIG. 1*b;* there is a free choice of which segments 14 will be caused to slide in the radial direction.

Material is fed pursuant to arrow 16, with the antibuckling element performing the very function of preventing the hollow member to be shaped in the shaping cavity 3 from buckling while material is fed pursuant to arrow 16; this would be the case if, at shaping temperature and corresponding shaping pressure, the material supply or the compression force were selected to be so high that the hollow member to be shaped were caused to buckle in the shaping cavity.

Figure 2:
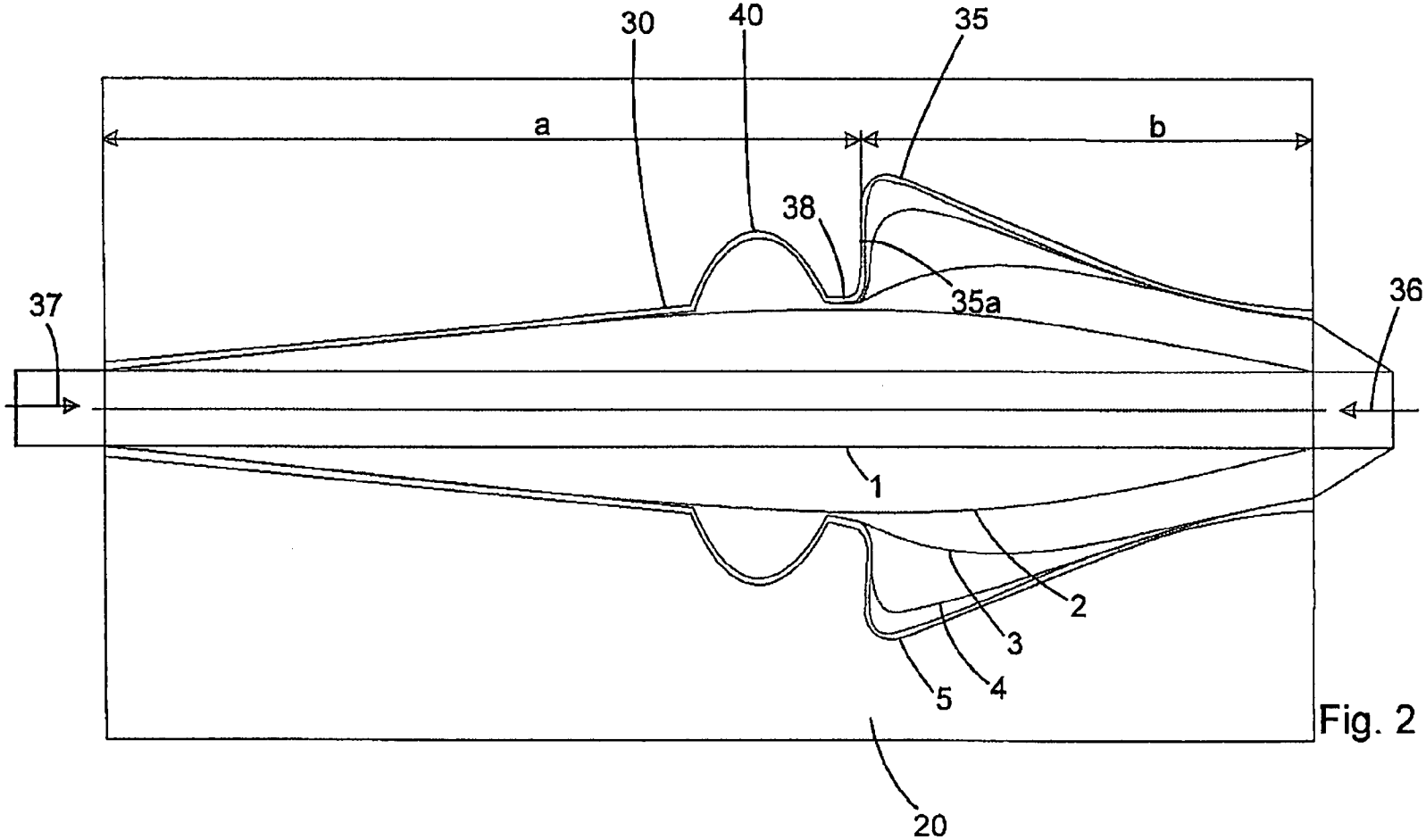
FIG. 2 schematically shows the temperature distribution in a shaping tool with a shaping cavity comprising a region of a high degree of shaping and regions of low degrees of shaping.

The illustration shown in FIG. 2 shows a tool 20 with a shaping cavity 30, said shaping cavity 30 having a region of highest degree of shaping in the region of arrow 35 and another region of a lesser degree of shaping (arrow 40). The region of highest degree of shaping (arrow 35) is characterized by a stepped configuration of the cavity. Moreover, the region of highest degree of shaping and the region of the lowest degree of shaping are characterized in that the spacing (b) between the highest degree of shaping from the neighboring workpiece outlet is half the length of the spacing (a) of the highest degree of shaping from the opposite workpiece outlet. The important point hereby is that material cannot be fed from the side pursuant to arrow 36 by compressing the hollow member to be shaped (not shown in FIG. 2) into regions 38 located after the step (arrow 35*a*) since this step acts as a natural barrier. The objective when shaping under internal pressure always is that the wall thickness of the hollow member is substantially equal over the entire length after shaping. If the shaping temperature were highest in the region of the highest degree of shaping pursuant to arrow 35, meaning in particular in the region of the stepped configuration of the shaping cavity, there would be no possibility to supply material through compression of the hollow member pursuant to arrow 36 since overturned portions would form because of the temperature in the region of the arrows 35 and 35*a* respectively. Material cannot be fed pursuant to arrow 37 if e.g., a bend, a barrier or any other change in cross section in this region and/or if the length (a) of the hollow member with the low degree of shaping is much greater than the length (b) of the region of the hollow member having the highest degree of shaping since the friction between the hollow member to be shaped and the wall of the shaping cavity is much too high to ensure that material fed pursuant to arrow 37 reaches the region just before the highest degree of shaping, meaning the region indicated by the arrow 38. If, accordingly, the temperature in the region of the arrow 35 or 35*a* is kept lower than in the region of the arrow 38, the cavity is first filled there, it being made certain that sufficient material is allowed to flow by virtue of the temperature distribution into this part, that is to say into the region of the arrow 38. It is not until this region has been formed that the region having the highest degree of shaping and also the region pursuant to arrow 40 will be formed.

The chronological process of filling out the cavity is made obvious in FIG. 2 by the lines designated by numbers. Line 1 hereby designates the outlet cross section of the hollow member to be shaped. Line 2 marks the start of the forming process also in the region pursuant to arrow 38 and in other regions. After the region 40 has been formed with material being fed from the direction indicated by the arrow 36, the region b (arrow 35) starts to be formed, forming of this region being complete when the region of the highest degree of shaping (arrow 35) corresponding to line 5 has been formed. After the region 38 is formed, the temperature may be highest in the region of the highest degree of shaping (arrow 35).

Figure 3:
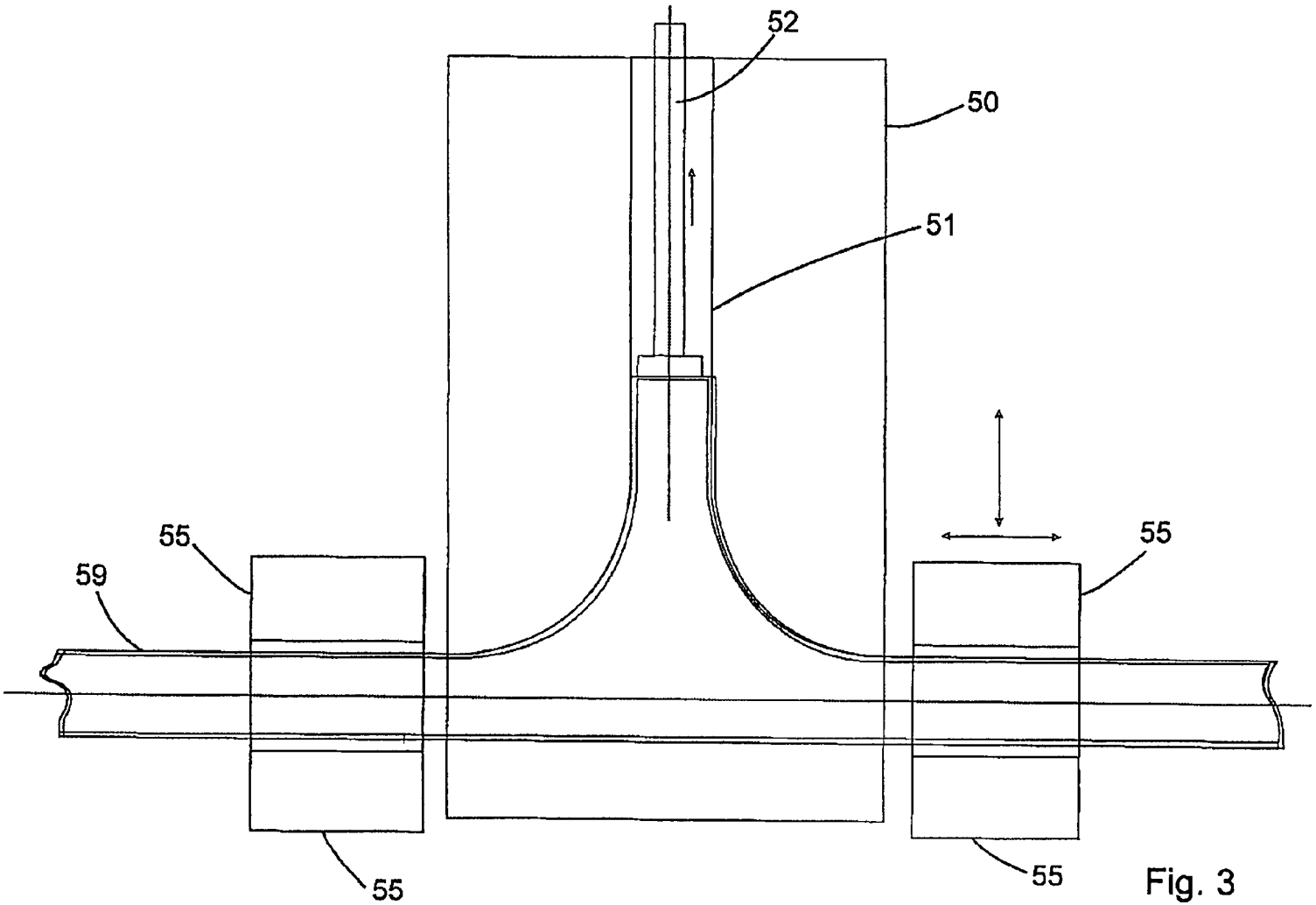
FIG. 3 shows a tool with jaws for receiving the workpiece that are radially and axially movable and disposed outside of the tool.

In the illustration shown in FIG. 3, the tool labelled at 50 has approximately the same temperature as the hollow member 59 to be shaped. The shaping cavity hereby has the shape of an elongated hollow member with a dome 51 placed thereon. The problem in forming this dome 51 now is that a considerable amount of material must be fed into the dome 51 in order to ensure a substantially equal material cross section over the cross section of the entire hollow member to be shaped. At its upper end, the dome 51 is closed with a dome plunger 52, said plunger being configured to be slidable in an upward direction within the dome as shaping proceeds.

Since, as already explained, both the tool and the hollow member to be shaped, that is to say the workpiece, should have the same temperature, namely the shaping temperature, the tubular hollow member would deform outside of the tool if it were merely compressed in the axial direction so that no further material could be fed to the interior of the tool, meaning into the shaping cavity. Insofar, jaws 55, which are configured in a shell-type fashion and take hold of the metallic hollow member on its circumference, are now provided. These shell-type jaws 55 are movable in the radial and/or in the radial and axial direction and may additionally be cooled. These jaws 55 perform the function of feeding material while preventing the hollow member from loosing its initial shape in the region of the jaws, i.e., from expanding during material supply. This means that the jaws 55 have inner dimensions that substantially match the outer dimensions of the hollow member in its initial shape. It is thereby to make certain that the axial material supply, which causes the jaws to open and to simultaneously slide in the axial direction into the opened position and to next grasp the hollow member and to slide toward the tool, is so fast that the hollow member outside the tool has no time to deform, that is during the time in which the jaws 55 are not engaging the hollow member to be shaped. In this context it has been found advantageous to reduce the shaping pressure during the short period of time in which the jaws are not engaging the hollow member for the purpose of supplying material. This means that internal pressure is applied intermittently, in accordance with the rhythm of the moving jaws.

Figure 4:
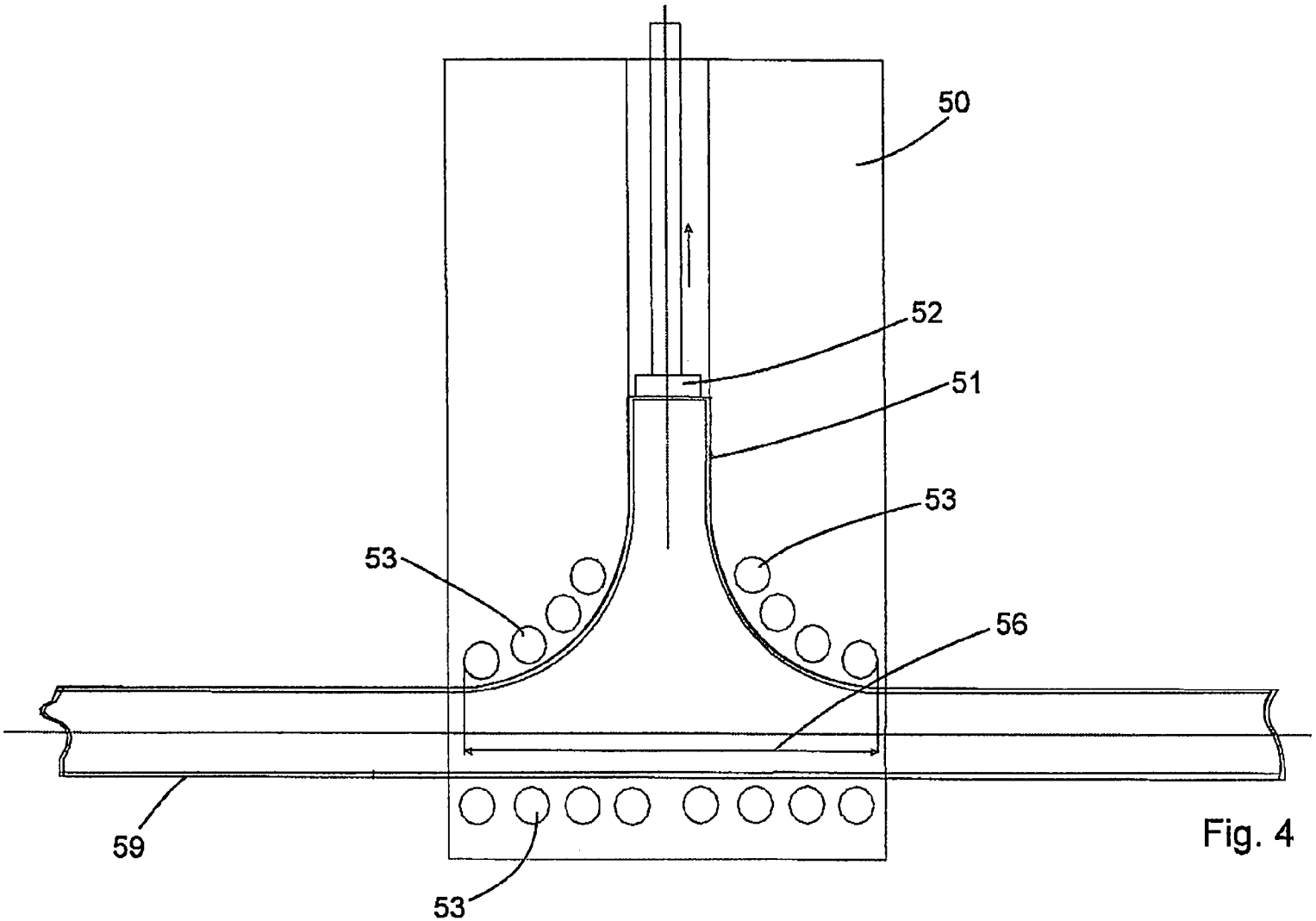
FIG. 4 shows the temperature distribution in the tool and the temperature of the workpiece during shaping, with the workpiece being compressed for feeding material.

In the illustration shown in FIG. 4 there is provided that the temperature of the tool is much lower than the shaping temperature of the workpiece during shaping. This can be achieved in that the workpiece, meaning the metallic hollow member 59 to be shaped, is inductively heated in the region of the shaping cavity 56 (arrow 53). Outside of the actual shaping region, meaning outside of the shaping cavity, the workpiece is not heated so that outside the shaping cavity and more specifically outside of the tool as such the workpiece has so low a temperature that it cannot deform under the shaping pressure applied. If, accordingly, the temperature of the workpiece outside the cavity or also outside of the tool is so low that shaping will not occur, not even if overpressure is applied, material can be fed into the shaping cavity through axial compression without substantial frictional losses between the wall of the shaping tool and the workpiece. It may hereby be necessary that the tool projection outside the shaping cavity, meaning the neutral cavity of the tool, has so great a spatial extension that the tool allows cooling below the shaping temperatures of the hollow member to be shaped to take place in the region of this neutral cavity.

In the region where the dome 51 is implemented there is again provided a plunger 52 that is slidable in the axial direction of the dome as shaping proceeds.

Figure 5A:
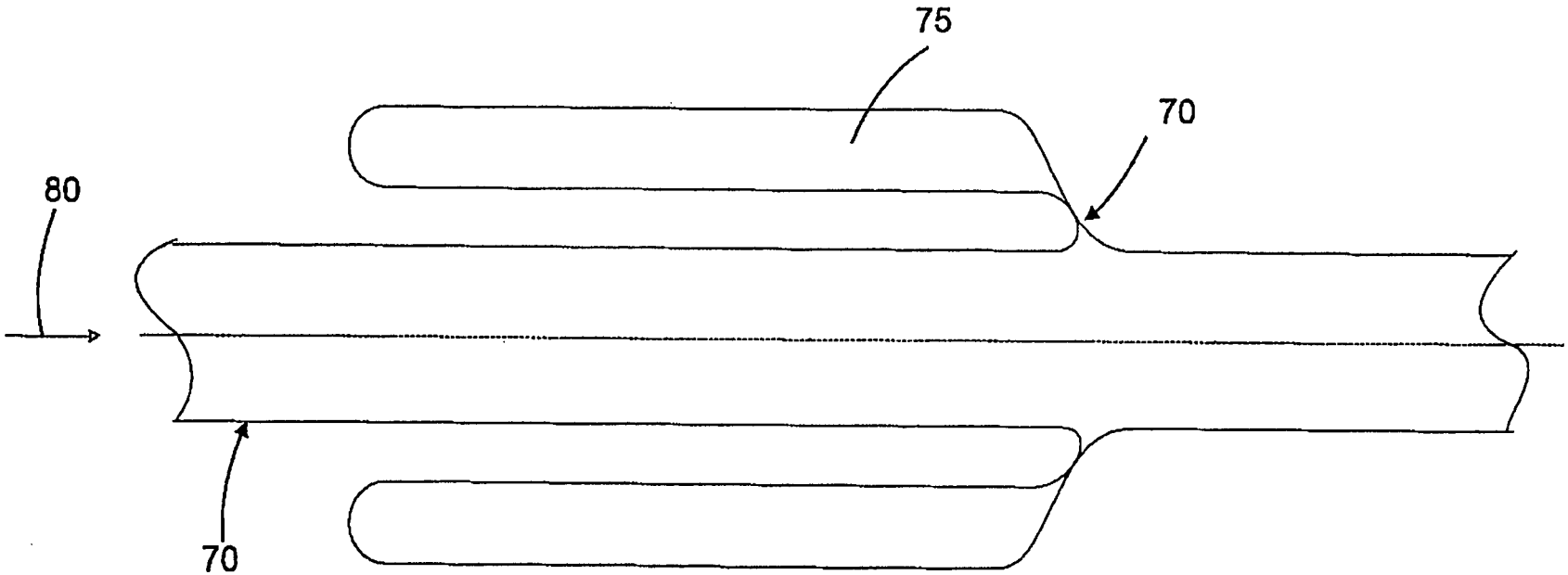
FIG. 5*a*, 5*b* show the manufacturing of a workpiece in which, once a, for example cylindrical, hollow member has been formed, the workpiece is further compressed at the same shaping temperature but with the shaping pressure in the shaping cavity being reduced.

In accordance with FIG. 5*a*, the hollow member 70 has a substantially closed jacket 75. This jacket 75 is hollow and can be manufactured in the following manner:

First, the hollow member 70 is placed into a shaping cavity which has an outer surface matching the cross sectional shape of the jacket 75. Once the shaping cavity has been filled out, the internal pressure is reduced with the shaping temperature being maintained. Now the hollow member is compressed from the direction shown by the arrow 80 under reduced internal pressure and simultaneously at a maintained shaping temperature. The overturned portion 75 thus obtained forms the hollow jacket. This hollow jacket 75 may serve as a cooler for liquid or gas circulating in the hollow member, the jacket can be filled with a coolant.

Figure 5B:
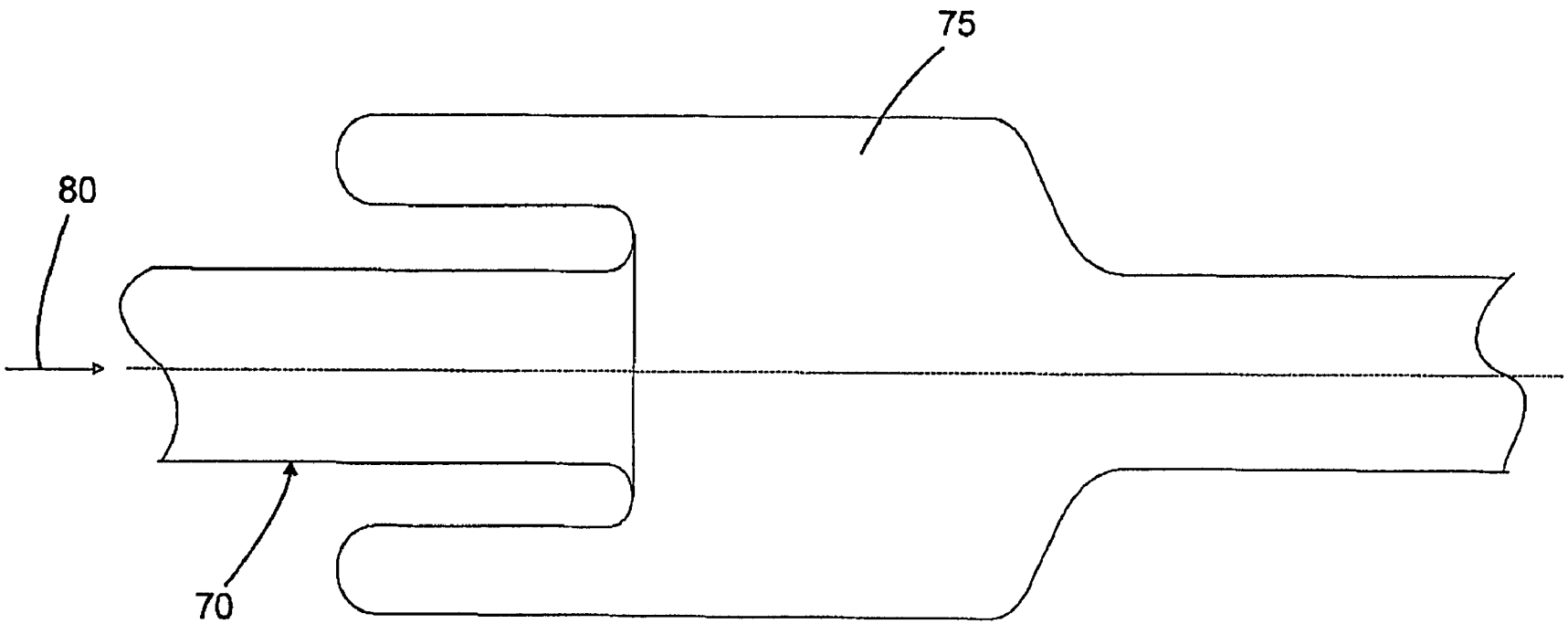

The illustration shown in FIG. 5*b* only differs from FIG. 5*a* by the fact that the jacket 75 is not closed. The overturned portion extends only partially over the length of the formed member.

Figure 6A:
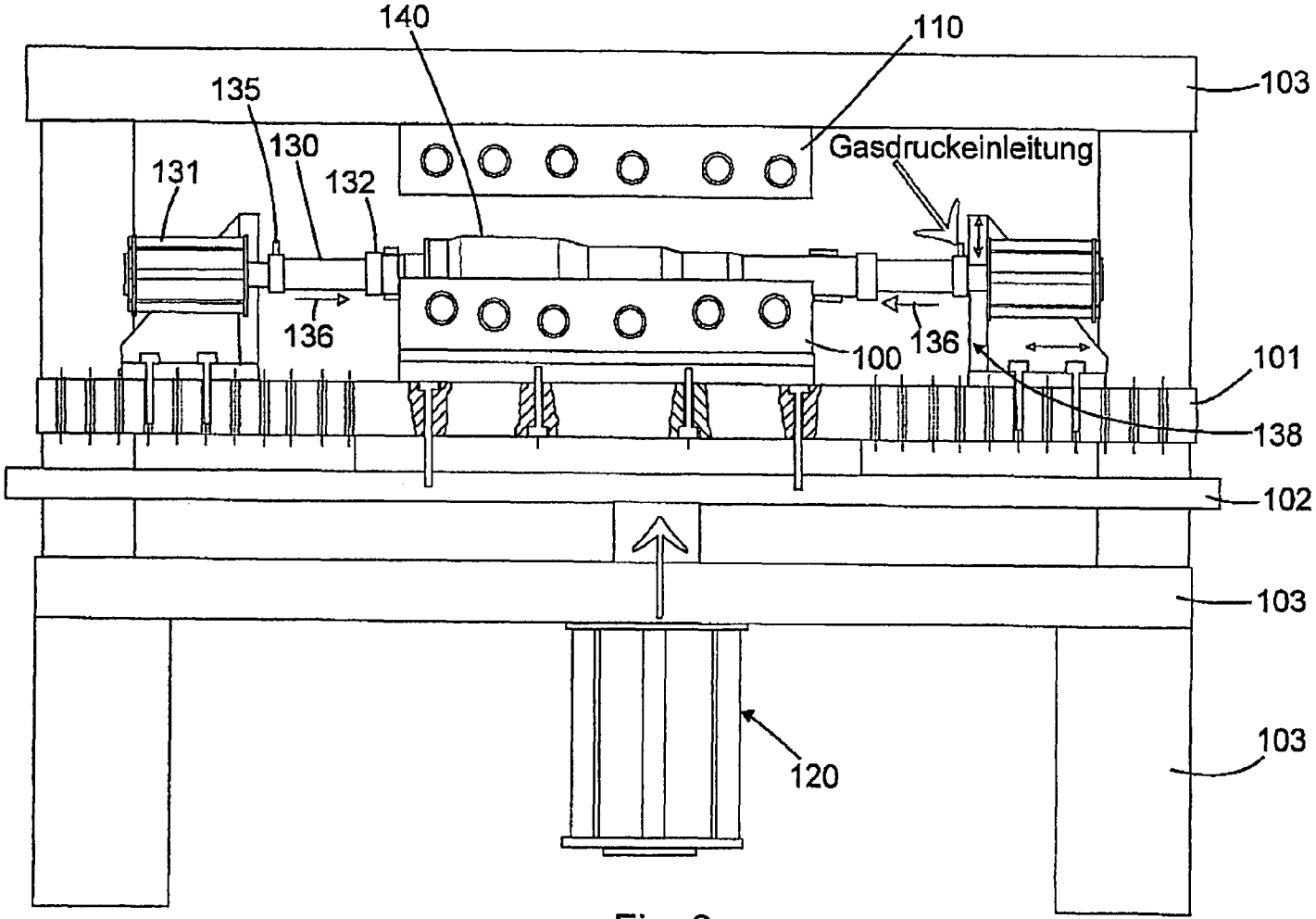
FIG. 6*a*, 6*b* show the tool in a side view and in a top view inclusive of the arrangement of the cooling members at the outlet of the tool.
Figure 6B:
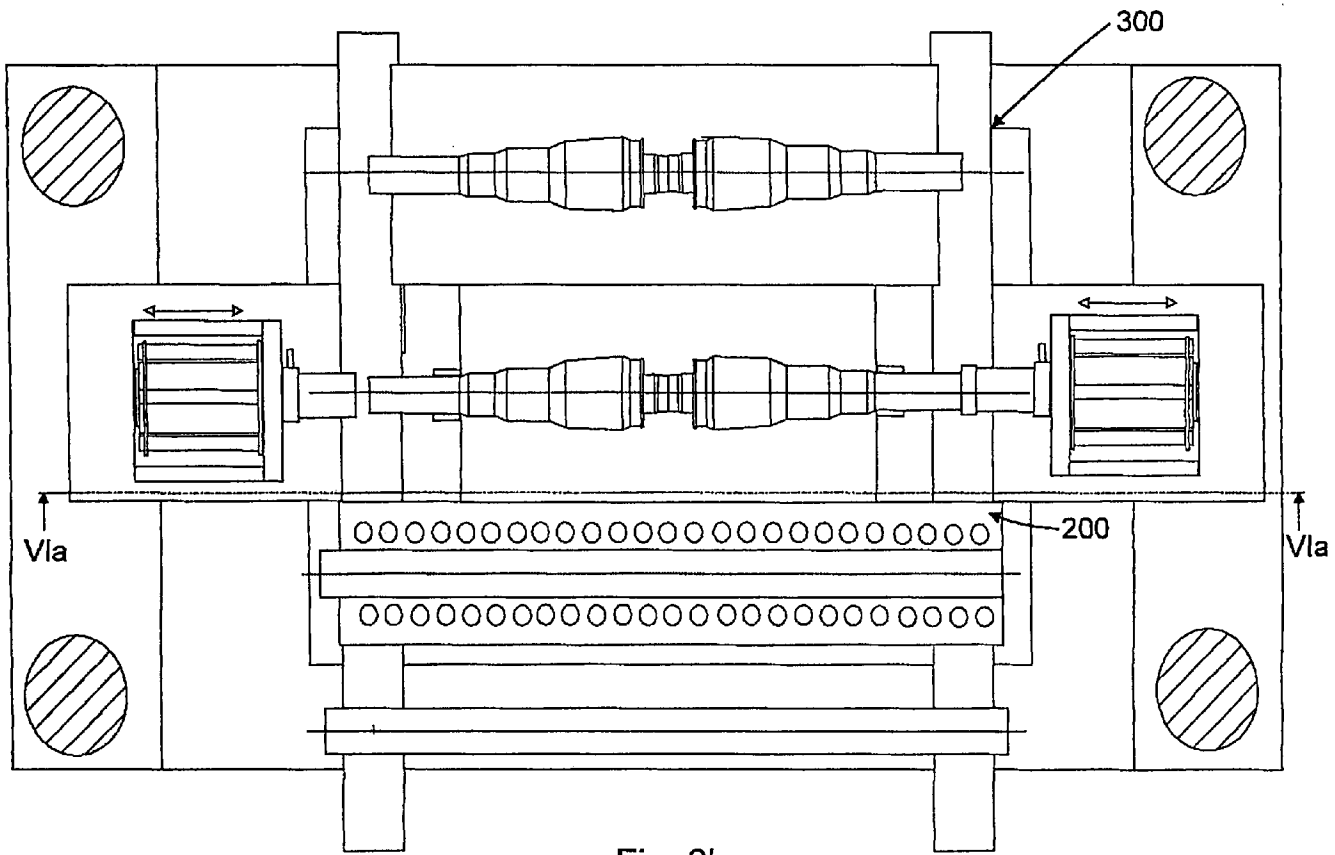

In accordance with FIG. 6*a*, 6*b*, a shaping tool is characterized by a lower tool part 100 and an upper tool part 110 that may be moved toward each other by a hydraulic cylinder 120 for closing the tool, i.e., the tool consisting of an upper and a lower part is closed by means of this hydraulic cylinder 120 for closing the tool. The lower part 100 of the tool is carried on a so-called tool plate 101 that abuts the plate of the installation 102. The hydraulic cylinder for closing the tool, which is labelled at 120, acts onto said installation plate 102. The hydraulic cylinder 120 for closing the tool is located on the base frame labelled at 103. The compression apparatus 130 is located in the region of the shaping cavity in the upper tool part or in the lower tool part respectively. The compression apparatus 130 comprises a piston and cylinder drive 131 and a device 132 for sealing the front end of the hollow member 140 to be shaped. The compression apparatus 130 further comprises a gas inlet 135 for applying an internal pressure onto the hollow member 140. Compression for feeding material into the shaping cavity occurs in the direction pursuant to the arrows 136. The piston rod of the piston and cylinder arrangement 131 is carried on an adjustable holding means 138 on the base plate 101 of the tool.

The important point hereby is that the hydraulic system in form of the tool-closing cylinder is arranged in the region of the lower part of the tool in order to prevent hydraulic liquid from penetrating the cavity in the case of leakage. This on the one side results in reduced fire risk but also prevents hydraulic liquid from penetrating the cavity, which may also lead to a change in the friction rates. At the respective end of the shaping tool there is provided a cooling apparatus for preventing the hollow member from expanding during shaping.

As can be seen from FIG. 6*b*, the tool for shaping the hollow member is part of a complete system comprising a pre-heating station 200 and a cooling station 300 mounted downstream of the shaping tool. The work cycle of the pre-heating station 200 in which the hollow member to be shaped is inductively heated is synchronized with the time the hollow member needs to be shaped in the shaping tool as described with respect to FIG. 6*a*. The same applies to the cooling station 300. Meaning, all the work cycles, pre-heating, shaping and cooling as well, are all synchronized.

Another important point is that the molding tool shown in FIG. 6*a* can be encapsulated for performing the forming process under inert gas conditions, e.g., nitrogen or argon, in order to prevent corrosion and scaling of the workpiece.

I claim:

1. A method for shaping a hollow metallic workpiece, said method comprising the steps of:

providing a mold tool having a shaping cavity defined therein wherein in the use of said mold tool, a workpiece is shaped in said shaping cavity; said mold tool further including a heater which heats at least a portion of the mold tool so that a workpiece which is disposed in said mold tool is heated thereby, said mold tool further including a neutral cavity wherein in the use of said mold tool no significant shaping of a workpiece takes place in said neutral cavity;

providing a hollow, metallic workpiece;

disposing said workpiece in said mold tool so that a first portion of the length thereof is disposed in said shaping cavity, a second portion of the length thereof is disposed in said neutral cavity, and a third portion of the length thereof projects from said mold tool wherein said second portion is disposed between said first portion and said third portion;

activating said heater so as to heat said at least a portion of said mold tool whereby said mold tool transfers heat to said second and/or third portion of said workpiece;

pressurizing the interior of said workpiece;

applying an axially directed compressive force to said third portion of said workpiece so as to bias said third portion towards said first portion; and maintaining said third portion of said workpiece at a temperature which is less than the temperature of said first portion of said workpiece during the time said workpiece is pressurized so that said pressurization does not deform said third portion.

2. The method of claim 1, wherein said step of maintaining said third portion at said temperature which is less than the temperature of said first portion comprises actively cooling said third portion.

3. The method of claim 1, wherein the step of applying an axially directed compressive force to the third portion of the workpiece includes the further step of supporting said third portion with a clamp.

4. The method of claim 3, wherein said clamp includes jaws which are configured to surround said workpiece and to be axially and radially movable relative thereto.

5. The method of claim 1 including the further step of providing an anti-buckling element which is engageable with said workpiece and which is operable to prevent said workpiece from buckling when said axially directed compressive force is applied thereto.

6. The method of claim 5, wherein said anti-buckling element is disposed so as to engage said second and/or said first portion of said workpiece.

7. The method of claim 5, wherein said anti-buckling element is disposed in said neutral cavity.

8. The method of claim 5, wherein said anti-buckling element is configured so that said workpiece is axially displaceable relative thereto.

9. The method of claim 1 including the further step of heating at least a portion of the workpiece before the step of disposing said workpiece in said mold tool.

10. The method of claim 1, wherein the step of providing said workpiece comprises providing a workpiece having a non-uniform cross section.

11. The method of claim 10, wherein the wall thickness of said workpiece varies along its length.

12. The method of claim 1, wherein at least a portion of the shaping cavity of said mold tool is defined by a ceramic surface.

13. The method of claim 12, wherein said ceramic surface is comprised of a member selected from the group consisting of: zirconium nitride, niobium nitride, aluminum titanate, boron nitride, and combinations thereof.

14. The method of claim 1, wherein the step of applying said axially directed compressive force comprises intermittently applying said axially directed compressive force.

15. The method of claim 1, wherein the step of pressurizing the interior of said workpiece comprises intermittently pressurizing the interior of said workpiece.

16. A method for shaping a hollow metallic workpiece, said method comprising the steps of:

providing a mold tool having a shaping cavity defined therein wherein in the use of said mold tool, a workpiece is shaped in said shaping cavity; said mold tool further including a heater which heats at least a portion of the mold tool so that a workpiece which is disposed in said mold tool is heated thereby, said mold tool further including a neutral cavity wherein in the use of said mold tool no significant shaping of a workpiece takes place in said neutral cavity;

providing a hollow, metallic workpiece;

disposing said workpiece in said mold tool so that a first portion of the length thereof is disposed in said shaping cavity, a second portion of the length thereof is disposed in said neutral cavity, and a third portion of the length thereof projects from said mold tool wherein said second portion is disposed between said first portion and said third portion;

activating said heater so as to heat said at least a portion of said mold tool whereby said mold tool transfers heat to said second and/or third portion of said workpiece;

pressurizing the interior of said workpiece; and maintaining said third portion of said workpiece at a temperature which is less than the temperature of said first portion of said workpiece during the time said workpiece is pressurized so that said pressurization does not deform said third portion.

* * * * *